United States Patent [19]

Kelly

[11] Patent Number: 4,985,708

[45] Date of Patent: Jan. 15, 1991

[54] ARRAY ANTENNA WITH SLOT RADIATORS OFFSET BY INCLINATION TO ELIMINATE GRATING LOBES

[75] Inventor: Kenneth C. Kelly, Sherman Oaks, Calif.

[73] Assignee: Hughes Aircraft Company, Los Angeles, Calif.

[21] Appl. No.: 476,999

[22] Filed: Feb. 8, 1990

[51] Int. Cl.[5] ..... H01Q 13/10

[52] U.S. Cl. ..... 343/771; 343/770; 343/767

[58] Field of Search ..... 343/771, 770, 767, 768, 343/769; 333/113, 122

[56] References Cited

U.S. PATENT DOCUMENTS

| | | | |
|---|---|---|---|
| 2,447,549 | 8/1948 | Willoughby | 343/771 |
| 2,479,209 | 8/1948 | Chu | 343/771 |
| 3,220,007 | 11/1965 | Thourel | 343/771 |
| 3,308,467 | 3/1967 | Morrison, Jr. | 343/771 |
| 3,599,216 | 8/1971 | Paine | 343/771 |
| 3,697,993 | 10/1972 | Jones et al. | 343/771 |
| 4,716,415 | 12/1987 | Kelly | 343/771 |
| 4,752,781 | 6/1988 | Wood | 343/771 |
| 4,755,821 | 7/1988 | Itoh et al. | 343/771 |
| 4,839,662 | 6/1989 | Wood | 343/771 |

*Primary Examiner*—Rolf Hille
*Assistant Examiner*—Hoanganh Le
*Attorney, Agent, or Firm*—Steven M. Mitchell; Robert A. Westerlund; Wanda K. Denson-Low

[57] ABSTRACT

An antenna (20) is formed of a two-dimensional array of radiating apertures disposed in rows (22) and columns (24), each of the radiating apertures being formed as slots (40) within a top broad wall (28) of a waveguide (26). The width of the broad wall is many times greater than the height of a sidewall (32, 34) of the waveguide, the waveguide having a rectangular cross section. A wave launcher (56) connected to a first end wall (36) of the waveguide launches a higher-order mode of electromagnetic wave wherein the order of the mode is equal to the number of columns of the radiating elements. The top wall (28) has an enlarged thickness of approximately one-eighth free-space wavelength. Each of the slots extends via a passage (46) from an input port (48) at an interior surface (52) of the top broad wall to an output port (50) at an exterior surface (54) of the top broad wall. All of the slot output ports are centered at the locations of maximum intensity of electric field. In order to provide for magnetic coupling from an electromagnetic wave within the waveguide to longitudinal sides of each slot, each slot passage is inclined so as to displace the slot input port to a location wherein there is sufficient magnetic field component parallel to the slot to couple power from the wave to be radiated from the antenna. Inclinations of successive ones of the slot passages are staggered for coupling from magnetic wave components of equal polarization and phase.

20 Claims, 3 Drawing Sheets

ARRAY ANTENNA WITH SLOT RADIATORS OFFSET BY INCLINATION TO ELIMINATE GRATING LOBES

BACKGROUND OF THE INVENTION

This invention relates to broadside beam antennas formed by an array of slot radiators and, more particularly, to an array of plural columns of slot radiators extending through a thick plate of a broad wall of a waveguide, wherein phasing of electromagnetic waves is established by inclination of passages connecting input and output ports of the slots in alternating fashion for coupling with an electromagnetic wave within the waveguide.

An array of slot radiators disposed in a straight line along a wall of a waveguide is employed frequently to generate a beam of electromagnetic power. As a typical example of an array antenna composed of slot radiators, the antenna comprises a waveguide of rectangular cross section wherein the width of a broad wall is approximately double the height of a narrow wall, and wherein the slots are formed within one of the broad walls. Antennas are constructed also of a plurality of these slotted waveguides arranged side-by-side to provide a two-dimensional array of slot radiators arranged in rows and columns. To facilitate description of the antenna, a column of slot radiators is considered to be oriented in the longitudinal direction to a waveguide, in the direction of propagation of electromagnetic power, and a row of slot radiators is considered to be transverse to the waveguide. An antenna composed of a single waveguide generates a fan beam while an antenna composed of a plurality of the waveguides arranged side by side produces a beam having well-defined directivity on two dimensions.

Antennas employing slot radiators may have slots which are angled relative to a center line of the broad wall of the waveguide, or may have slots which are arranged parallel to the center line of the broad wall of the waveguide. In order to attain a desired linear polarization, and a desired illumination function of the radiating aperture of the entire antenna, the configuration of the antenna of primary interest herein is to be configured with all of the slots being parallel to each other.

A cophasal relationship among the radiations from the various slot radiators is employed for generating a broadside beam directed perpendicularly to a plane containing the plurality of waveguides. Herein, the antenna comprising the two-dimensional array of rows and columns of radiators with slots oriented in the column direction is of primary interest. One method of obtaining the cophasal relationship is to position the slot radiators in alternating offsets fashion along a centerline of each waveguide broad wall. The transverse offsetting of the slot radiators permits a coupling with a nonzero value of longitudinal component of the magnetic field of the electromagnetic wave in each of the waveguides. With a spacing of one-half guide wavelength along the direction of propagation within the waveguide, the alternation in the offsetting compensates for periodic variations in the phase of the magnetic field so as to obtain a constant value of phase in the radiated field. The waveguides are fed in phase and operate in the TE10. Since the spacing and pattern of alternation of offsetting of slot radiators is the same in each of the waveguides, good control of the radiated beam is obtained without excessive grating lobes.

However, in the event that a $TE_{n,0}$ rectangular waveguide, having a single broad wall with n columns and many rows of slots is employed in lieu of the plurality of parallel slotted waveguides, then the relationship among the wave components in each of the columns changes. The phasing of the components of the wave in one column is 180 degrees out of phase with the wave components of the contiguous column. To compensate for this phasing of the wave components, the pattern of offset slot radiators of one column must be reversed from that of the contiguous columns to insure identity of phasing.

A problem arises in that the foregoing arrangement of reversed patterns of offset slot radiators introduces excessive grating lobes in addition to the desired beam. The resulting loss of antenna gain militates against the convenience of using a single broad-walled waveguide as antenna, unless the grating lobes can be eliminated.

But, to facilitate manufacture of the antenna, and to reduce the overall weight of the antenna, it would be preferable to construct the antenna of this single waveguide, wherein the broad walls are of sufficient width to form multiple columns of slot radiators within a single broad wall of a wide waveguide operating in the $TE_{n,0}$ mode. This would eliminate the need for constructing the antenna with n individual waveguides joined side by side.

SUMMARY OF THE INVENTION

The aforementioned problems are overcome and other advantages are provided by an antenna comprising an array of slot radiators disposed in an arrangement of parallel columns and parallel rows. All of the slot radiators are formed within a single top broad wall of a broad waveguide having rectangular cross section. The slot radiators are parallel to each other and, in a preferred embodiment of the invention, the longitudinal dimension of each slot is oriented parallel to the columns. The waveguide is excited by a higher-order transverse electric wave $TE_{n,0}$ rectangular waveguide mode wherein n may be any integer.

In accordance with the invention, the top broad wall is constructed with increased thickness, a thickness equal to approximately one-eighth free-space wavelength being employed in a preferred embodiment of the invention. This thickness is one-quarter the length of a slot, approximately one-half free-space wavelength, but larger than a width of the slot, approximately one-twentieth free-space wavelength. Due to the increased thickness of the top broad wall, the slot can be viewed as a three-dimensional passage from the interior of the waveguide to the exterior of the waveguide, the slot having an input port and an output port at opposite ends of the passage. The input port of the slot is at the interior surface of the top broad wall, and the output port of the slot is at the exterior surface of the top broad wall. By inclining the slot passage to the right or to the left, the input port can be displaced to the right or to the left of the output port.

In the situation wherein a $TE_{n,0}$ electromagnetic wave is present in the waveguide, the output port of each of the slots is located exactly on the line at one of the n lines of maximum value of electric field. Thus, the center of the output port of every slot is located in line with all other slots in its column. On the exterior there appears to be no offset. At the location of the output port of a slot, there is no longitudinal component of the magnetic field parallel to a side of the slot for coupling of electromagnetic power between the waveguide mode and the slot. However, by displacing the input port of the slot to either the right or the left of the location of the output port of the slot, the input port is placed in the location of a non-zero value of the longitudinal component of the magnetic field. Therefore, by displacing the input port relative to the output port of a slot, the slot is able to couple electromagnetic power from the wave within the waveguide for radiating the power from the exterior of the waveguide. The displacement of the input port of a slot relative to the output port of the slot introduces an inclination of the slot passage which connects the input and the output ports.

It is noted that the sense of the magnetic vector may be clockwise or counter clockwise depending on the location of a slot. In order to radiate electromagnetic waves from the various slots with equal phase, it is necessary to compensate for the differences in sense of the magnetic field vector. This is accomplished by alternating the inclination of the slot passages such that one slot passage is inclined to the left while the next slot passage is inclined to the right. The alternate inclination of slot passages applies equally to the succession of slots in a row and to the succession of slots in a column. Thereby, the input ports of the various slots couple electromagnetic waves which are in phase for radiating a uniformly phased wave to achieve broadside radiation.

This facilitates manufacture in that the assembly of bottom wall plus sidewalls and end walls of the broad waveguide can be cast or milled as a single assembly. Manufacture is then completed by simply placing the top broad wall with the radiating slots therein upon the sidewalls and the end walls to complete the foregoing assembly.

BRIEF DESCRIPTION OF THE DRAWING

The aforementioned aspects and other features of the invention are explained in the following description, taken in connection with the accompanying drawing wherein.

DETAILED DESCRIPTION

Figure 1:
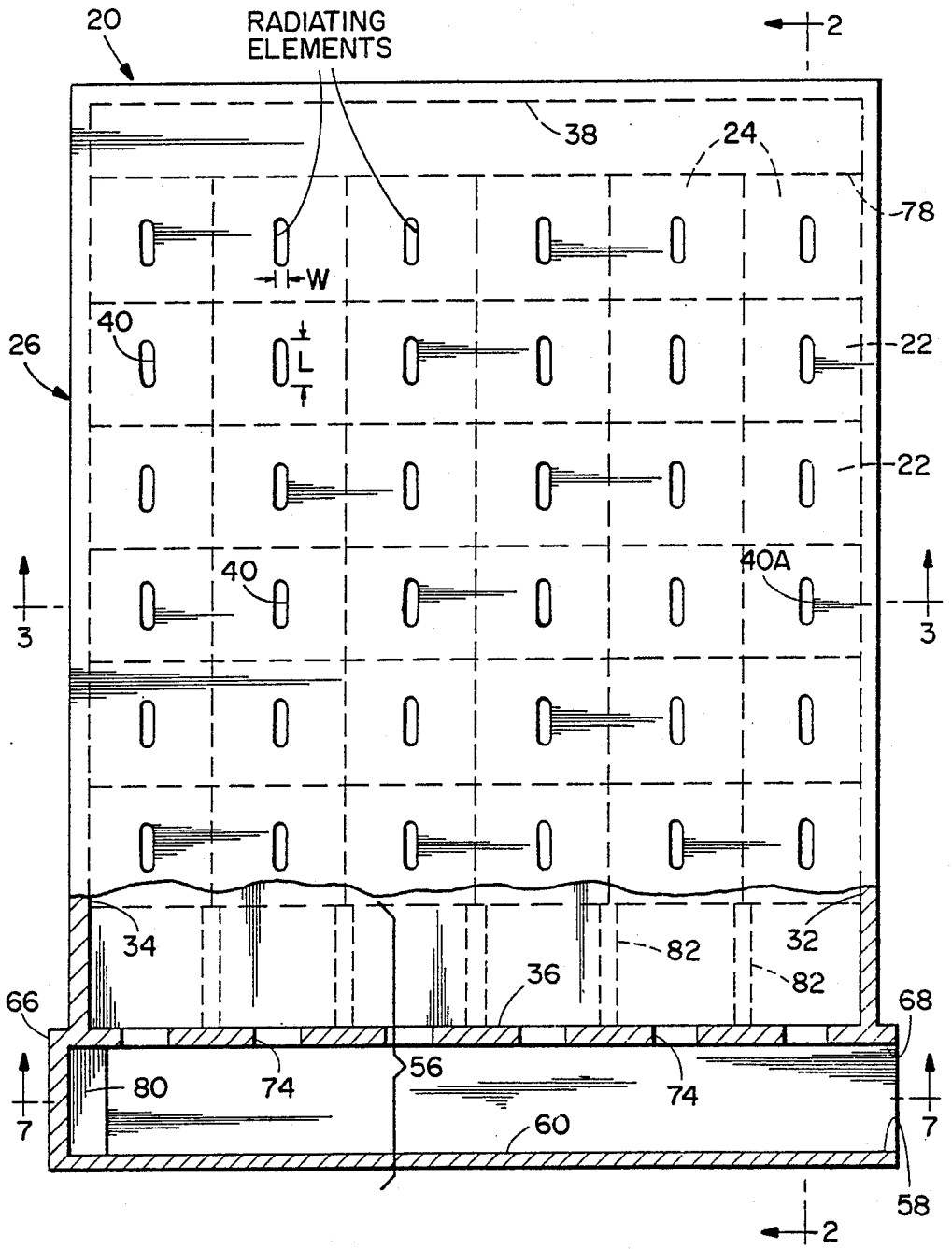
FIG. 1 is a plan view, partially sectioned and shown in FIG. 2 along line 1—1, of an antenna including a broad-walled waveguide thereof constructed in accordance with the invention.
Figure 2:
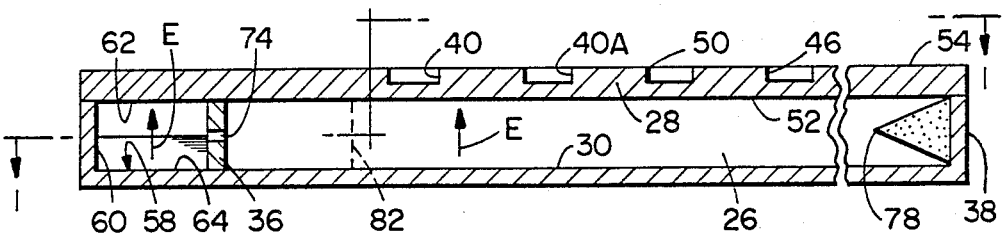
FIG. 2 is a sectional view of the antenna taken along the line 2—2 in FIGS. 1 and 4.
Figure 3:
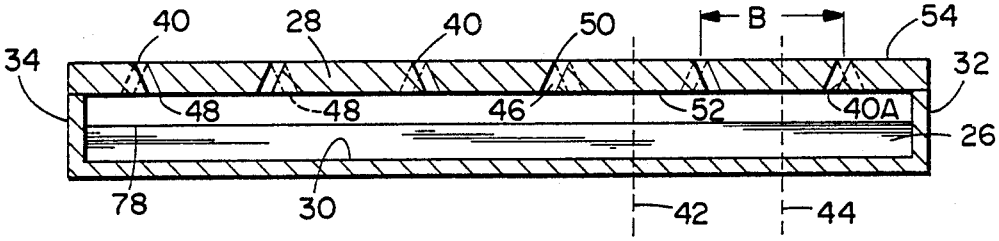
FIG. 3 is a sectional view of the antenna taken along the line 3—3 in FIG. 1.
Figure 4:
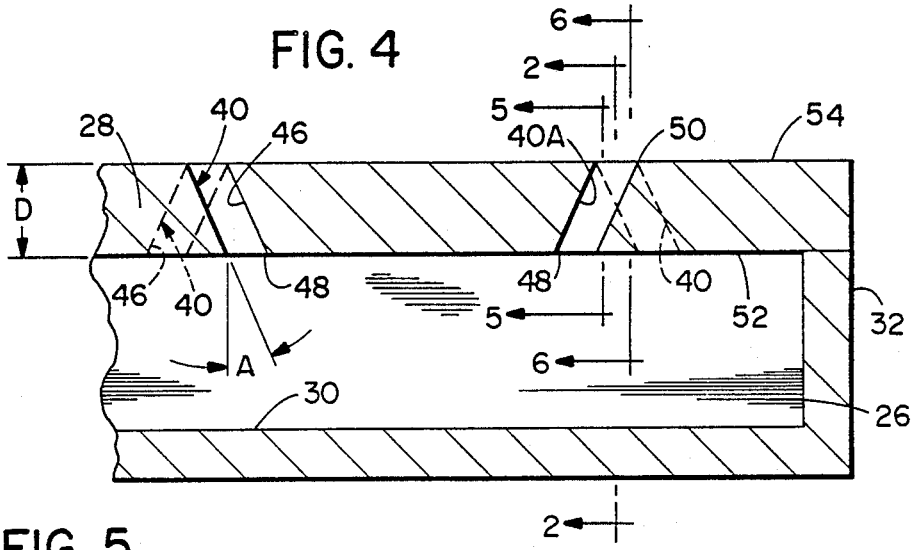
FIG. 4 is an enlarged fragmentary portion of the sectional view of the antenna of FIG. 3, the view showing part of the waveguide of the antenna.
Figure 5:
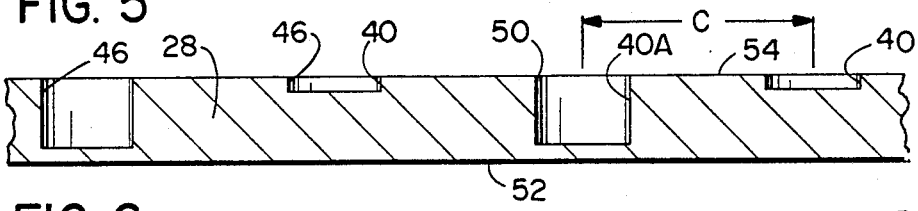
FIG. 5 is an enlarged fragmentary sectional view of a top broad wall of the waveguide taken along the line 5—5 in FIG. 4, the view being parallel to and offset from the view of FIG. 2.
Figure 6:
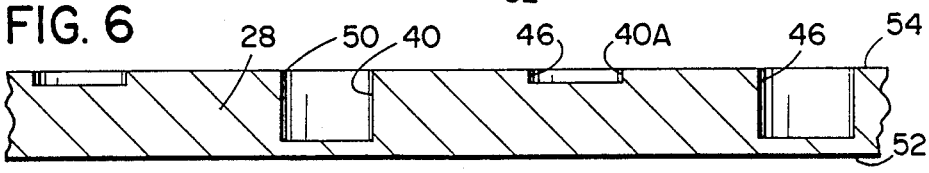
FIG. 6 is an enlarged fragmentary sectional view of the top broad wall of the waveguide taken along the line 6—6 in FIG. 4, the view being parallel to and offset from the view of FIG. 2.

With reference to FIGS. 1–3, there is shown an antenna 20 constructed in accordance with the invention, the antenna 20 having a planar array of radiating elements arranged in a rectangular array and located at sites defined by a set of rows 22 and columns 24. The rows 22 and the columns 24 are indicated by phantom line in FIG. 1. The antenna 20 comprises a microwave structure having the form of a cavity or broad waveguide 26. The waveguide 26 comprises a top broad wall 28, a bottom broad wall 30, a right sidewall 32, a left sidewall 34, a front wall 36, and a back wall 38. The broad walls 28 and 30 are disposed parallel to each other, are spaced apart from each other, and are joined together at their peripheral edges by the sidewalls 32 and 34, the front wall 36 and the back wall 38. The terms "top" and "bottom" are used for purposes of convenience in relating the description of the antenna to the sectional views of FIGS. 2 and 3, and do not imply a preferred orientation to the antenna 20 which may be operated in any desired orientation. Similarly, the terms "right" and "left" are employed to relate the antenna components to the portrayal in FIG. 1, and do not imply any preferred orientation to the antenna 20. Also, the description of the antenna 20 will be presented in terms of generating and transmitting a beam of radiation, it being understood that the operation of the antenna is reciprocal so that the description applies also to the reception of a beam of radiation.

The broad walls 28 and 30, the sidewalls 32 and 34, the front wall 36 and the back wall 38 are each formed of an electrically conductive material, preferably a metal such as brass or aluminum, which produces a totally enclosed space which may be viewed as a cavity or a waveguide. In view of the fact that microwave energy is to be applied at the front wall 36 and extracted from each of the radiating elements, the microwave structure of the antenna will be described as the waveguide 26. There are two embodiments of the waveguide 26, one embodiment employing a traveling wave and having a termination (as will be described hereinafter) to prevent generation of a reflected wave, and the other embodiment employing a standing wave of varying standing-wave ratio and having a shorting end wall to reflect a wave in the reverse direction.

Each of the radiating elements is formed as an aperture within the top broad wall 28, each aperture being configured as a longitudinal slot 40 having dimensions of length, L and width, W, the length of a slot 40 being many times greater than the width of a slot 40. The longitudinal dimension of each slot 40 is oriented parallel to the direction of the columns 24. The center of each slot 40 is indicated at the center of a square or rectangular cell defined by the intersecting phantom lines of a row 22 and a column 24.

In describing the waveguides 26, it is convenient to consider a longitudinal view of a column 24 as is disclosed in FIG. 3 between vertical phantom lines 42 and 44, or between lines 44 and the right sidewall 32. With respect to the longitudinal views of the column 24, the portion of the waveguide 26 enclosed within a column has the cross-sectional dimensions of an approximately 2×1 (aspect ratio) rectangular waveguide wherein a broad wall has a cross-sectional dimension which is approximately twice the cross-sectional dimension of a sidewall. In view of the numerous columns 24, both of the broad walls 28 and 30 are many times greater in cross-sectional dimension than the sidewalls 32 and 34. This configuration of the cross-section of the waveguide 26 enables the waveguide 26 to support a higher-order mode of transverse electric (TE) rectangular waveguide mode in which the order of the mode is equal to the number of columns. By way of example, there may be 5, 10, or even 100 columns; the embodiment disclosed in FIGS. 1–3 is provided with six of the columns 24 and six of the rows 22. To facilitate an understanding of the several views of the waveguide 26, and of the orientations of the slots 40, one of the slots 40 located at the intersection of the right column with the third row from the bottom of FIG. 1 is designated as slot 40A, this slot appearing in all of FIGS. 1–6 and 8.

In accordance with an important feature of the invention, and with reference to FIGS. 1–6, the top broad wall 28 is constructed with increased thickness, D, a thickness equal to approximately one-eighth free-space wavelength being employed in a preferred embodiment of the invention. This thickness is substantially less than the length of a slot 40 which is approximately one-half free-space wavelength. This thickness is substantially greater than the width of a slot 40 which is approximately one-twentieth free-space wavelength. Due to the increased thickness of the top broad wall 28, the slot 40 can be viewed as a three-dimensional passage, or conduit of microwave energy, from the interior of the waveguide to the exterior of the waveguide. Accordingly, the slot 40 is to be described as comprising a passage 46, and an input port 48 and an output port 50 at opposite ends of the passage 46. The input port 48 of the slot 40 is at the interior surface 52 of the top broad wall, and the output port 50 of the slot 40 is at the exterior surface 54 of the top broad wall 28.

Figure 8:
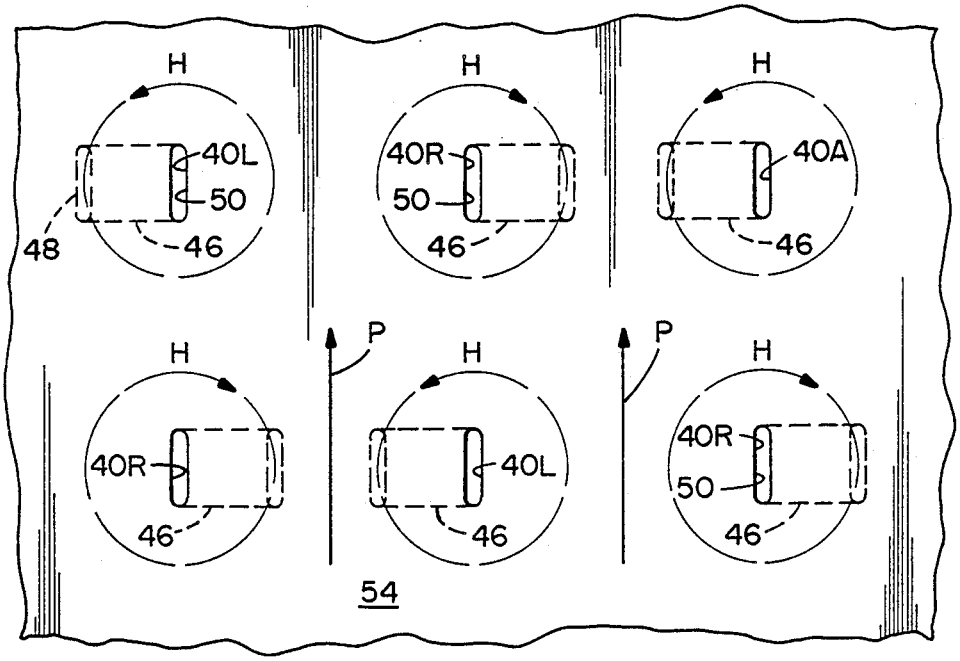
FIG. 8 is diagrammatic plan view of a fragmentary portion of the top broad wall showing an array of slots with exaggerated displacement of input port relative to output port of a slot, the view being superposed on circulating paths of the magnetic field of a transverse electric wave within the waveguide.

By inclining the slot passage 46 to the right or to the left, the input port 48 can be displaced to the right or to the left of the output port 50. To indicate right and left displacement, the slots 40 may be identified further by the letters R and L respectively, as shown in FIG. 8, wherein a slot 40R is shown in exaggerated fashion with the input port displaced to the right, and a slot 40L is shown with the input port displaced to the left. The angle of inclination, A, (FIG. 4) of a passage 46 in any of the slots 40 relative to a normal to a plane of the top broad wall 28 has a magnitude of 13 degrees and 36 minutes in a preferred embodiment of the invention constructed of nineteen rows and twenty columns for a total of 380 slots 40. The angle of inclination, A, to be employed depends on the amount of power which is to be coupled from the wave in the waveguide 26 through a slot 40, an increase in the magnitude of the angle increasing the amount of power to be coupled. The spacing, B, (FIG. 3) on centers, between output ports 50 of successive slots 40 in a row 22 is approximately 0.7 free space wavelengths. The spacing, C (FIG. 5), on centers, between output ports 50 of successive slots 40 in a column 24 is one-half guide wavelength.

With reference to FIGS. 1–7, and in accordance with a further feature of the invention, electromagnetic power is to be applied via a higher-order-mode wave launcher 56 located at the front wall 36 for launching a $TE_{6,0}$ wave which travels within the waveguide 26 from the front wall 36 to the back wall 38 past all of the slots 40. The launcher 56 comprises a waveguide 58 having a rectangular cross section and being formed of the aforementioned front wall 36 which serves as a sidewall of the waveguide 58, and a second sidewall 60 opposite the wall 36. The waveguide 58 includes top and bottom broad walls 62 and 64 (FIG. 2) which are joined by the walls 36 and 60. The waveguide 58 is closed off by an end wall 66 extending between the four walls 36, 60, 62 and 64. An input port 68 of the waveguide 58 connects with an external source 70 (FIG. 9) of electromagnetic power for applying an electromagnetic wave to the waveguide 58. The source 70 may be connected to the input port 68, by way of example, by a waveguide 72. The transverse dimension of each of the broad walls 62 and 64 is double the transverse dimension of each of the walls 36 and 60 to provide a 2×1 aspect ratio to a cross section of the waveguide 58.

Coupling slots 74 are located in the front wall 36, each coupling slot 74 having a linear form with a length and a width, the length being many times greater than the width. The coupling slots 74 are oriented with their sides parallel to the broad walls 62 and 64, the coupling slots 74 being located half-way between the broad walls 62 and 64. The coupling slots 74 are spaced apart on centers by one-half the guide wavelength in the longitudinal direction along the waveguide 58. The waveguide 58 is energized with an electromagnetic wave in the $TE_{1,0}$ mode in which the electric field, E, is perpendicular to the broad walls 62 and 64 as shown in FIG. 2. The electric fields coupled through each of the slots 74 induce the aforementioned transverse electric wave in the waveguide 26 with electric field, E, disposed perpendicularly to the broad walls 28 and 30 as shown in FIG. 2. The actual dimensions of the antenna 20 and of the launcher 56 are selected in accordance with the frequency of electromagnetic power to be radiated from the antenna 20.

Figure 7:
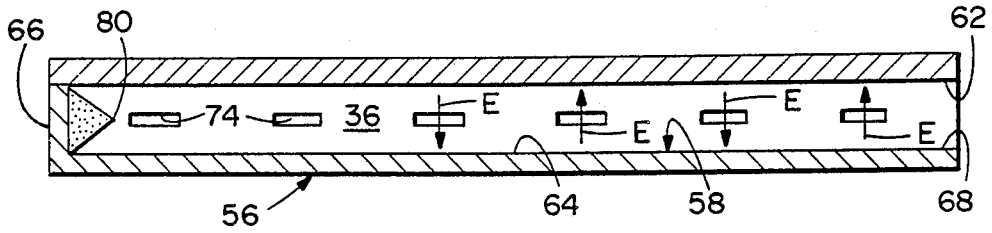
FIG. 7 is a sectional view of the antenna taken along the line 7—7 in FIG. 1.

In the waveguide 58 of the launcher 56, the direction of the electric field vector, E, alternates in phase from one of the coupling slots 74 to the next of the coupling slots 74, as indicated in FIG. 7. This produces the alternation in the sense of electric fields in the waveguide 26 which is characteristic of the alternation in the electric field sense of a higher-order mode of TE wave in a direction transverse to the direction of propagation of power. This alternation in the sense of the electric field is compensated by the alternating inclination of the slot passages, as will be described in further detail in FIG. 8, so as to produce a coupling of the magnetic field vector of opposite sense at the slots 40 in successive positions along each row and each column of the antenna 26. Accordingly, radiations from all of the slots 40 are in phase. Also, the radiation from all the slots 40 have the same polarization in view of the parallel disposition of all of the slots 40.

FIG. 8 shows a portion of the top broad wall 28 with the slots 40 therein. Superposed upon the array of slots 40, FIG. 8 presents diagrammatically a representation of a portion of the electromagnetic wave traveling in the waveguide 26, the direction of power flow being indicated by arrows P. As is well known in the propagation characteristic of a traveling TE wave, as well as the configuration of electric and magnetic fields of a standing TE wave, the electric field lines are directed normally to the top and the bottom broad walls of the waveguide 26 (FIG. 2), the sense of the electric vector being reversed each half guide wavelength along a column 24 (FIG. 1) of the waveguide 26. In the higher order mode of the TE wave, the alternating configuration of the electric field vector alternates in sense also along each row 22 of the waveguide 26. The magnetic field, H, encircles the electric field. The encirclements of the magnetic field lines are represented schematically in FIG. 8 by circles, though in actuality, the paths are more complex. The representation of magnetic fields shown in FIG. 8 is based on a standing wave; however, this representation also applies for describing operation of the invention for the case of a traveling electromagnetic wave.

The location of the slots 40 in the cells defined by the rows 22 and the columns 24 of FIG. 1 coincides with the locations of maximum intensity electric fields and, therefore, with the centers of encirclement of the magnetic fields. Therefore, in the representation of FIG. 8, the circles of magnetic field, H, are shown centered about each of the output ports 50 of the respective slots 40R and 40L. It is noted that the slots 40R and 40L alternate in inclination both along the direction of a column and along the direction if a row. Furthermore, the sense, clockwise or counterclockwise, of encirclement of the magnetic field alternates with the locations of the slot output ports 50.

It is noted that along a center line of each of the output ports 50, the direction of the magnetic field is transverse to the center line. Therefore, there is little or no coupling of electromagnetic power from the magnetic field to the respective slots. Such coupling is attained by providing a magnetic field component which is parallel to the long sides of a slot.

In accordance with the invention, each of the slots is provided with a passage 46 which is inclined so as to displace the input port 48 of each slot to the right in the case of the slots 40R and to the left in the case of the slots 40L. The displacement of the slot input ports 48 brings the slot input port 48 to a location wherein the encirclement of the magnetic field provides a magnetic field component which is parallel to the long side of a slot. This permits coupling of electromagnetic power from the magnetic field at the interior surface 52 of the top broad wall 28 (FIGS. 2 and 3) and the slot input ports 48 also located at the interior surface 52 of the top broad wall 28. However, the displacement of the slot input ports 48 does not affect the locations of the slot output ports 50 which are retained in their array on the exterior surface 54 of the top broad wall 28, the array being depicted in FIG. 1.

Figure 9:
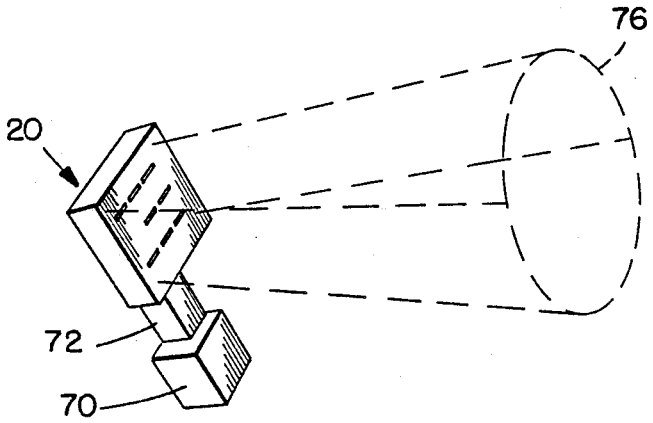
FIG. 9 is a stylized view of the antenna transmitting a beam provided by radiation from slots arranged in rows and columns.

It is important to retain the slot output ports 50 uniformly positioned in their array in order to obtain generation of a beam, such as the beam 76 depicted in FIG. 9, which beam has a desired two-dimensional directivity pattern which is free of the four grating beams which result from offsetting slot output ports from their locations in a regular array of the broad waveguide 26. Thereby, by inclining the slot passages 46, the invention attains the object of coupling electromagnetic power into a slot by a component of the magnetic field parallel to the long side of a slot input port 48 while retaining the regular array of locations of slot output ports 50 for desired prevention of the generation of unwanted "grating lobes" also known as second-order beams.

It is an object of the invention to attain the same phase to radiations emitted by each of the slot output ports 50. It is noted that the direction of the electric field emanating from each of the slot output ports is transverse to the longitudinal direction of each of the slot output ports 50. The sense of the outputted electric field depends on the direction, clockwise or counterclockwise, of encirclement of the magnetic field. In view of the alternating directions of encirclement by the magnetic field, it is necessary to couple power from the magnetic field in a manner which compensates for the alternating direction of encirclement of the magnetic fields. This is accomplished by alternation of the inclination of the slot passages 46, either to the right or to the left, as is depicted in FIG. 8. The alternation of inclination occurs among successive ones of the slots in a column and among successive ones of the slots in a row of the array of slots depicted in FIGS. 1 and 8. By way of example, as depicted in FIG. 8, the magnetic vector is shown progressing past each slot input port 48 in a downward direction (with respect to the orientation of the drawing) so that each the slot input port 48 is excited with an electromagnetic wave of the same polarization. The displacements of the slot input ports 48 from the slot output ports 50 in FIG. 8 has been exaggerated so as to facilitate the schematic representation. The actual physical configuration is closer to that disclosed in FIGS. 2–6.

It is noted that the excitation of the slots 40, as shown in FIG. is by use of a wave which has been launched to convey power in the direction of a column. However, the invention also applies to a situation in which a broad waveguide has slots oriented both in the directions of a column and of a row. The slots which are oriented in the direction of a row require a separate wave launcher. In practice, in the concurrent generation of such two orthogonal waves, it is necessary to employ paired launchers, such that there is a launcher located along each of the four sides of the antenna as depicted in U.S. Pat. No. 4,716,415 issued in the name of Kenneth C. Kelly on Dec. 29, 1987. However, in view of the orthogonal directions of propagation of power in the two waves, and in view of the orthogonal relationship of a set of slots parallel to a column with a set of slots parallel to a row, there is essentially no interaction between the two waves, and between the radiations of the two sets of slots. In each of the sets of slots, the slot passages are to be inclined as has been taught hereinabove for the case of the single wave with the single launcher depicted in FIG. 1. In the event that two sets of orthogonal slots would be used, the slots would be arranged in the manner of repeating squares as depicted in U.S. Pat. No. 4,716,415.

To facilitate manufacture of an antenna, such as the antenna 20 with its wave launcher 56, it is desirable to avoid any microwave structural components secured to both the top and the bottom broad walls. No components, other than slotted apertures, should be provided on the top broad wall. Such an arrangement of the microwave components facilitates manufacture because an assembly of the components which form the antenna 20 can be readily molded and machined as a single unitary structure after which the top broad wall is simply brought into place and positioned in the manner of a cover to the assembly. It is considerably more difficult to fabricate a microwave structure in which microwave components must be secured to both the top and the bottom broad walls. The present invention avoids this difficulty of construction. Herein, there are no microwave components disposed in the interior space of the waveguide 26 which interconnect both the top and the bottom broad walls. Selection of a specific portion of an electromagnetic wave to produce a desired phase and polarization to a signal coupled from the wave is accomplished solely by inclination of slot passages in a thickened top broad wall. It is noted that the theory of the invention applies also to waveguides of other configurations, even to a waveguide of solid dielectric slab in which the slot passages would become inclined vanes (not shown) protruding from the outer surface of the waveguide.

As noted above, the waveguide 26 can be operated in a standing wave mode or in a traveling wave mode. In the traveling wave mode, a terminating load 78 (FIGS. 1, 2, 3) is located at the back wall 38 to absorb power of the forwardly propagating electromagnetic wave which has not been coupled out of the waveguide by the slots 40. The forwardly propagating electromagnetic wave is more intense at the first row of slots 40, adjacent the launcher 56, than in the last row of slots 40 adjacent the back wall 38. Therefore, it is desirable to enlarge (not shown in the drawing) the slots 40 of the last row relative to the size of the slots 40 of the first row, and also to extend further the slot passages 46 of the last row, for increased displacement between slot input port 48 and slot output port 50, to enlarge the amount of power coupled from the slots of the last row. In this way, all of the slots radiate the same amount of power.

In the standing wave mode, the load 78 is not used and, instead, the position of the back wall 38 is located at a distance of one-quarter of the guide wavelength (or an odd number of one-quarter wavelengths) beyond the centers of the slots 40 of the last row so as to form a short circuit to the electromagnetic wave. Thereby, a portion of the forwardly propagating electromagnetic wave is reflected back from the back wall 38 to produce a standing wave of varying standing-wave ratio from which all of the power radiates through the slots 40 into space outside the waveguide 26. A maximum standing wave ratio is produced at the back wall 38, the standing wave ratio dropping in value towards the portion of the waveguide 26 near the front wall 36 due to extraction of power from the wave through the slots 40. The structure of the antenna 20 resembles that of a cavity wherein all of the slots 40 may be fabricated of the same size, and with all of the slots 40 radiating equal amounts of electromagnetic power.

It is to be understood, however, that in a practical situation for the radiation of the beam 76 of electromagnetic power, as depicted in FIG. 9, it is often desirable to introduce an amplitude taper in which the sizes of the slots 40 and the inclinations of the slot passages 46 are selected to produce a desired amplitude taper as is useful in shaping the beam 76. The beam 76 radiates broadside from the top broad wall 28 of the antenna 20. The coupling of the source 70 to the antenna 20, for example by use of the waveguide 72, allows the source 70 to be located at a place of convenience wherein the broadside beam 76 is unobstructed by the source 70.

In the construction of the launcher 56, there is also a choice of operating modes, namely to use the traveling wave mode or the standing wave mode. In the case of the traveling wave mode, a terminating load 80 is disposed in the front of the end wall 66 of the waveguide 58, the end wall 66 extending between the walls 36 and 60, and between the broad walls 62 and 64. Thereby, power inputted from the source 70 at the input port 68 of the waveguide 58 propagates down the waveguide 58 towards the end wall 66, most of the power being coupled via the slots 74 into the waveguide 26 while the remainder of the power is absorbed in the load 80. In the alternative mode of operation, the load 80 is deleted, and the end wall 66 is positioned one quarter of the guide wavelength (or an odd number of one-quarter wavelengths) beyond the center of the last of the coupling slots 74 to reflect the electromagnetic wave back towards the input port 68. This produces a standing wave of maximum standing wave ratio at the end of the waveguide 58 near the end wall 66, the standing wave ratio dropping in value towards the portion of the waveguide 58 near the input port 68 due to extraction of power from the wave through the coupling slots 74.

The first row 22 of the slots 40 is spaced away from the front wall 36 by a distance of at least one-quarter from the guide wavelength, preferably one-half of the guide wavelength, to allow for the radiations from the respective coupling slots 74 to combine to produce the higher-order mode TE wave. If desired, short sections of electrically conductive walls 82 (shown in phantom in FIGS. 1 and 2) may be employed at the interface between contiguous ones of the columns 24. The walls 82 extend outward from the front wall 36 towards the back wall 38 a distance of one-half of the guide wavelength. The walls 82 extend in height from the bottom broad wall 30 to the top broad wall 28, and are secured to the walls 30 and 36, but not to the top broad wall 28. The walls 82 may be incorporated into the launcher 56 to form the higher-order mode TE wave if desired; however, good performance of the launcher 56 has been attained in an experimental model of the antenna 20 without use of the walls 82.

It is to be understood that the above described embodiment of the invention is illustrative only, and that modifications thereof may occur to those skilled in the art. Accordingly, this invention is not to be regarded as limited to the embodiment disclosed herein, but is to be limited only as defined by the appended claims.

What is claimed is:

1. An antenna comprising:

a waveguide of rectangular cross section having two opposed broad walls and two opposed sidewalls extending lengthwise along the waveguide in a direction of propagation of electromagnetic power in the waveguide, the two broad walls being spaced apart and joined to the two sidewalls to define an enclosed space, the broad walls having a width which is many times greater than a height of the sidewalls to support a higher-order mode of transverse electric wave of microwave electromagnetic energy;

a set of radiating elements disposed in a first of said broad walls and arranged along said first broad wall in rows and columns, the columns being parallel to said sidewalls, a peak value of the electric field of said higher order mode of transverse electric wave being located at each of said columns; and wherein each of said radiating elements has an input port, disposed on an inner surface of said first broad wall of said waveguide communicating with said enclosed space, and an output port on an outer surface of said waveguide opposite said inner surface;

in each of said columns, the output port of each of said radiating elements is located on a center line of the column, and the input port of each of said radiating elements is located at an offset position displaced from the column center line;

in each of said columns, successive ones of said offset positions alternate in displacement from said column center line by displacement along said inner surface to a right side and to a left side of said column center line to provide a position array of alternating offset positions; and, in successive ones of said columns, the position arrays are reversed to provide for a row of radiating elements wherein the input ports of a succession of said radiating elements alternate in their offset positions to attain a coupling of magnetic field components of said wave to all the radiating elements of said waveguide to output radiating signals from the respective radiating elements having a common polarization and phase.

2. An antenna according to claim 1 further comprising:

a wave launcher disposed at a first end of said waveguide for directing electromagnetic power past said radiating elements toward a second end of said waveguide opposite said first end of said waveguide, said launcher launching an electromagnetic wave of higher-order mode wherein the order of the mode is equal to the number of the columns of said radiating elements the input port of each of said radiating elements being separate from the input port of every other one of said radiating elements.

3. An antenna according to claim 2 wherein each of said radiating elements is formed as a slotted aperture within said first broad wall.

4. An antenna according to claim 3 wherein the slotted aperture of each of said radiating elements comprises a single slot, the single slots off all of said radiating elements being parallel to each other.

5. An antenna according to claim 4 wherein said launcher introduces a phase shift of 180 degrees to said wave between successive ones of the columns, and wherein said slots of the slotted apertures are parallel to said sidewalls.

6. An antenna according to claim 4 wherein said slots of said radiating elements each have a length of approximately one-half free-space wavelength of said wave.

7. An antenna according to claim 6 wherein said slots each have a width approximately one-twentieth free-space wavelength.

8. An antenna according to claim 3 wherein said first broad wall has a thickness in a range of approximately one-sixteenth to one-quarter of the free space wavelength of said wave.

9. An antenna according to claim 8 wherein the thickness of said first broad wall is approximately one-eighth of the free space wavelength of said wave.

10. An antenna according to claim 9 wherein, in each of said radiating elements, there is a cylindrical passage connecting the input port with the output port.

11. An antenna according to claim 10 wherein said cylindrical passage is inclined.

12. An antenna according to claim 11 wherein said slots of said radiating elements each have a length of approximately one-half free-space wavelength of said wave; and, said slots each have a width of approximately one-twentieth free-space wavelength.

13. An antenna according to claim 12 wherein, in each of said radiating elements, there is an opening of said passage on said outer surface of said waveguide defining said output port, and an opening of said passage on said inner surface of said waveguide defining said input port.

14. An antenna according to claim 10 wherein the cylindrical passages of radiating elements disposed in each of said rows are inclined in a common plane.

15. An antenna comprising:

a waveguide of rectangular cross section having two opposed broad walls and two opposed sidewalls extending lengthwise along the waveguide in a direction of propagation of electromagnetic power in the waveguide, the two broad walls being spaced apart and joined to the two sidewalls to define an enclosed space, the waveguides supporting a transverse electric wave;

a set of radiating elements disposed in a first of said broad walls and arranged along said first broad wall in a column, a peak value of the electric field of said higher order mode of transverse electric wave being located at said column; and wherein each of said radiating elements has an input port disposed on an inner surface of said first broad wall of said waveguide communicating with said enclosed space, and an output port on an outer surface of said waveguide opposite said inner surface;

the output port of each radiating element is located on a center line of the column, and the input port of each radiating element is located at an offset position displaced from the column center line; and, successive ones of said offset positions alternate in displacement from said column center line by displacement along said inner surface to a right side and to a left side of said column center line to provide a position array of alternating offset positions.

16. An antenna according to claim 15 wherein each of said radiating elements is formed as a slotted aperture within said first broad wall.

17. An antenna according to claim 16 wherein said first broad wall has a thickness in a range of approximately one-sixteenth to one-quarter of the free space wavelength of said wave.

18. An antenna according to claim 17 wherein the thickness of said first broad wall is approximately one-eighth of the free space wavelength of said wave.

19. An antenna according to claim 18 wherein, in each of said radiating elements, there is a cylindrical passage connecting the input port with the output port.

20. An antenna according to claim 19 wherein said cylindrical passages of respective ones of said radiating elements are inclined in parallel planes.

* * * * *